United States Patent [19]

Mitchell et al.

[11] 4,070,852

[45] Jan. 31, 1978

[54] METHOD AND APPARATUS FOR COLD LIDDING CONTAINERS WITH ELASTOMERIC FILM

[75] Inventors: Richard Patrick Mitchell; Thomas Mathew Gorshe, both of Neenah, Wis.

[73] Assignee: American Can Company, Greenwich, Conn.

[21] Appl. No.: 749,769

[22] Filed: Dec. 13, 1976

Related U.S. Application Data

[62] Division of Ser. No. 642,367, Dec. 19, 1975, Pat. No. 4,011,119.

[51] Int. Cl.[2] ..... B65B 7/28; B67B 3/04; B67B 3/08; B67B 3/22

[52] U.S. Cl. ..... 53/297; 53/329; 425/60; 425/388; 425/500

[58] Field of Search ..... 53/290, 292, 296, 297, 53/329, 306; 425/60, 500, 501, 201, 317, 388; 264/230; 156/69

[56] References Cited

U.S. PATENT DOCUMENTS

| | | | |
|---|---|---|---|
| 2,036,105 | 3/1936 | Strout | 53/292 |
| 2,825,194 | 3/1958 | Page | 53/296 |
| 3,345,797 | 10/1967 | von Stoeser | 53/329 X |
| 3,609,940 | 10/1971 | Lemelson | 53/290 |
| 3,618,293 | 11/1971 | Loewenthal | 53/296 |
| 3,703,066 | 11/1972 | Marion et al. | 53/296 |
| 3,716,963 | 2/1973 | Amberg | 53/329 X |
| 3,962,844 | 6/1976 | Gordon | 53/329 X |

FOREIGN PATENT DOCUMENTS

| | | | |
|---|---|---|---|
| 600,196 | 6/1960 | Canada | 53/290 |

*Primary Examiner*—Othell M. Simpson
*Assistant Examiner*—Horace M. Culver
*Attorney, Agent, or Firm*—Robert P. Auber; Ira S. Dorman; George P. Ziehmer

[57] ABSTRACT

A method and apparatus for cold lidding open-top containers with roll-stock elastomeric film by holding a web of the film in air-tight relation across the bottom of a lidding chamber and about its periphery, evacuating the lidding chamber to stretch the web thereinto, inserting the top of the container into the lidding chamber, and releasing the stretched web over the top of the container whereby the inherent restorative characteristic of the web causes it to quickly contract, i.e. "snap" onto the periphery of the container to form a dynamic seal. The removal of the lidded container from the apparatus causes the container to be moved against a tripper plate to ready the apparatus for lidding the next container. The minimum recovery factor of the stretched film web should be about 85% of its original size.

4 Claims, 3 Drawing Figures

METHOD AND APPARATUS FOR COLD LIDDING CONTAINERS WITH ELASTOMERIC FILM

This is a division of application Ser. No. 642,367 filed Dec. 19, 1975, and now U.S. Pat. No. 4,011,119.

BACKGROUND OF THE INVENTION

This invention relates to a method and an apparatus for lidding open-top containers with elastomeric film without the application of heat.

The physical and mechanical properties of plastics make them particularly well suited as closuring or lidding material for the cup-shaped containers in general use particularly throughout the fast food industry. Plastic lids are impermeable to liquids, easily emplaceable, disposable, and relatively inexpensive. Many plastics of the thermoplastic, elastomer, and thermosetting groups have these desirable properties.

In the fast food industry, however, plastic lidding materials have been selected, almost exclusively, from among the thermoplastics. These thermoplastic materials have been used in several varieties of preformed lids and in a newer variety as a heat-shrunk film lid.

Speed of emplacement is an important factor in the choice of lid type. Preformed lids can be emplaced more quickly than the heat-shrunk films. A preformed lid has an outer skirt which, in a single step, is snapped over the top rim of the container. The thermoplastic film lid requires two steps: covering the container with an oversize piece of thermoplastic film and heat-shrinking the film against the periphery of the cup.

The most prominent shortcoming of the preformed lids is the inadequate seal between the lid and the container. This inadequacy manifests itself in several ways: first, the seal does not withstand jostling between the lid and other items; second, the juncture between the lid and the container is not leak-proof. Despite the poor seal, removing the stiff lids without spilling some of the contents can be troublesome. These lids have some additional drawbacks. The lidding process requires two hands and each cup size requires a specific lid size.

Some of the shortcomings of preformed lids are avoided by the use of film which is thermoformed or heat-shrunk over the top of the container. Such thermoplastic film may be emplaced with one hand by use of a counter-top lidding device designed for that purpose. In the current form, such counter-top devices first feed a fixed amount of a suitable thermoplastic film over the top of the container. The film, such as polyethylene, polyvinyl chloride, or polypropylene is then held over the top of the container while jets of hot air are blown against the edges or heat is applied by some other method. Because the heated edges of the film are in a somewhat fluid state, they collapse downwardly and are shrunk against the periphery of the cup.

Not all of the deficiencies of the preformed lids are obviated by such film lids; some, in fact, are increased. The heat necessary to effectuate the desired shrinkage can cause brittleness which weakens the film. A good heat-seal often makes the lid difficult to open. Contamination of the container in the heat-seal area with contents of the container can cause a poor seal. The heat-shrinking method also tends to be relatively slow. The demands of the industry for a fast and convenient method and apparatus for emplacing strong, leakproof, easily removable lids have not been met with the heat-shrunk thermoplastics.

SUMMARY OF THE INVENTION

This invention comprises a method and apparatus for cold vacuum stretching a web of elastomeric film over a container and releasing the web to allow the inherent restorative properties of the elastomeric material to contract the web about the periphery of the container to form a dynamic seal. The film should have a minimum recovery of about 85% of its original size. In particular, this invention retains the convenience of roll-stock dispensing, one-hand lid emplacement, and visibility of the contents, while quickly and conveniently producing a substantially stronger, leakproof seal. Emplacement of elastomeric films by this method and apparatus requires less time than methods for heat-shrinking film lids.

Because the peripheral seal is produced by stretching the elastomeric film and letting it contract onto the container, a dynamic frictional seal is formed by the continually exerted restorative force of the elastomeric film against the peripheral wall of the container. A filled container sealed in this manner is able to withstand considerable jostling, even inversion without spilling the contents. Such a sealed container is able to accommodate substantial deformation without breaking the seal and reduces the chance of inadvertent displacement of the lid. Yet, the elasticity of the film allows the lid to be easily removed when desired.

Further objects, features and advantages of this invention will be apparent from the following detailed description read in conjunction with the accompanying drawing exemplifying the principles of the invention.

DESCRIPTION OF A PREFERRED EMBODIMENT

Figure 1:
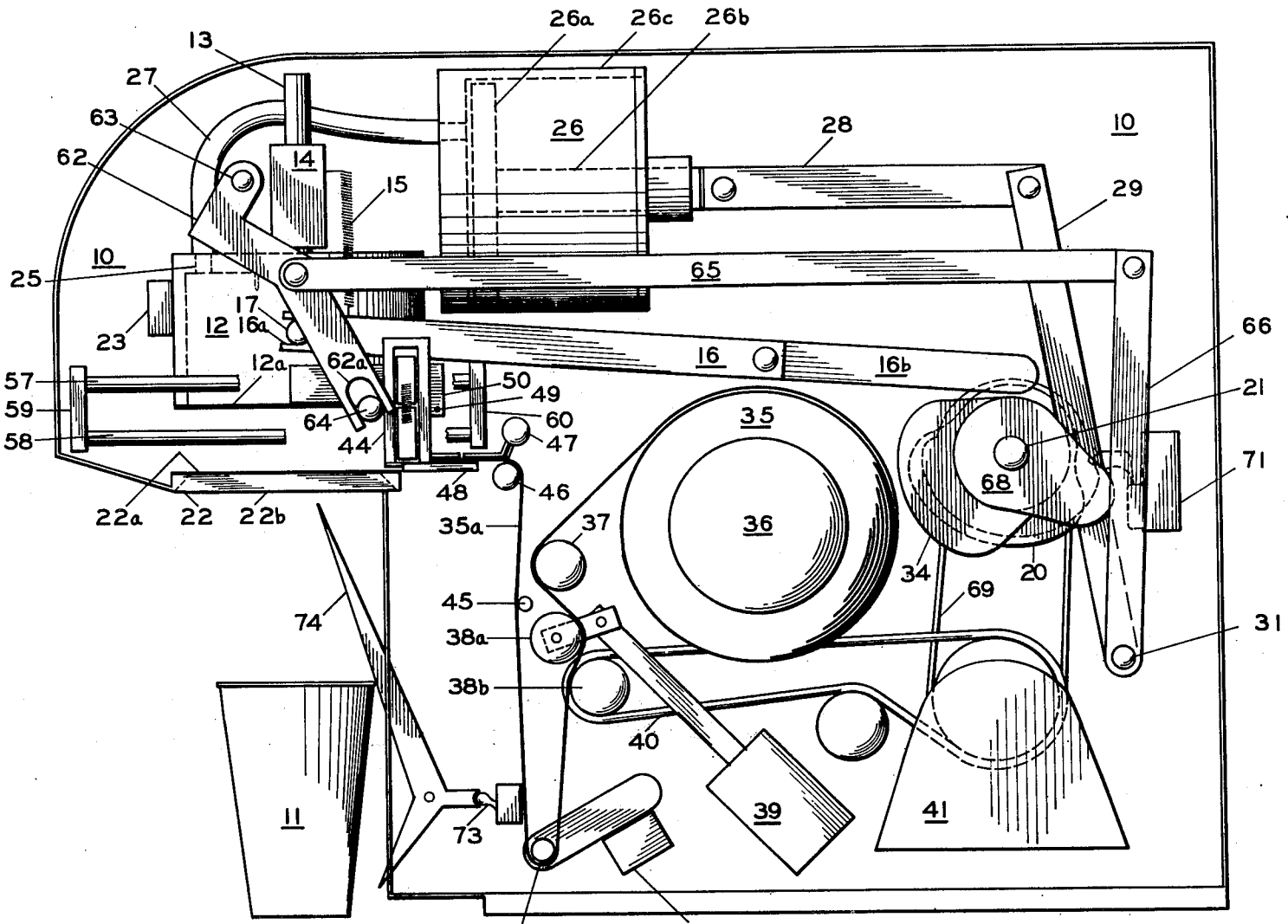
FIG. 1 is a side elevation view, somewhat simplified for illustrative purposes, of a lidding apparatus embodying the invention.

The countertop embodiment of the lidding apparatus, shown generally in FIG. 1 for exemplification, has a metal chassis 10 having a head portion **10*a* extending forwardly in spaced relation above a counter-top (not shown) on which the apparatus is designed to be supported. The head portion of the chassis is positioned so as to allow hand-held containers, such as 11**, of a variety of sizes to be manually placed thereunder for lidding.

Figure 2:
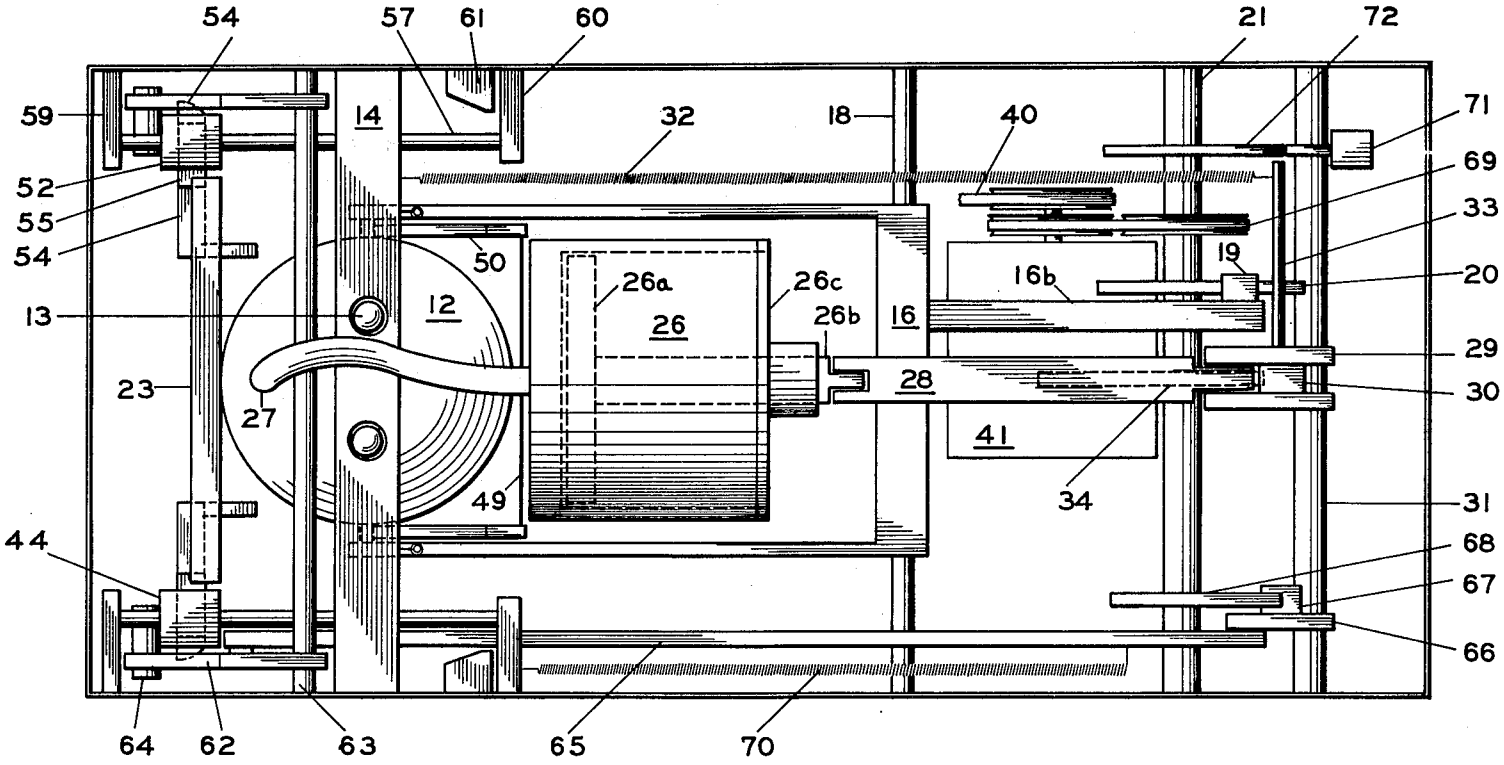
FIG. 2 is a simplified plan view of the lidding apparatus of FIG. 1 with the carriage assembly in its forward position.

As best shown in FIGS. 1 and 2, a vertically movable open-bottom lidding chamber 12 is mounted on guide rods 13 depending from an arrest bar 14 extending transversely across the inside of the head portion of the chassis. The lidding chamber is resiliently urged toward its upper position shown in FIG. 1 by tension springs 15 attached to the arrest bar and a bifurcated lever 16.

The lidding chamber is operatively attached to the bifurcated lever 16 by pins 17 in slots **16*a* formed in the bifurcated lever. The bifurcated lever pivots on axle 18 mounted to the chassis. The bifurcated lever is pivoted about its axle to move the lidding chamber to its lower position, shown in FIGS. 2 and 3, by the interaction between a cam follower 19 on the stem portion 16*b* of the bifurcated lever and the lidding chamber activating cam 20 shown in FIGS. 1 and 2. The lidding chamber activating cam is carried on a cam shaft 21 journalled in the sides of the chassis. In its lower position, the rubber sealing gasket 12***a* on the bottom edge of the lidding chamber abuts a rubber sealing gasket 22*a* on the upper surface of a horizontally disposed clamping plate 22 mounted across the bottom of the head portion of the chassis. The clamping plate 22 has an aperture 22*b* for permitting the top of the container to be lidded to be inserted into the lidding chamber.

The lidding chamber 12 is shown in a cylindrical configuration with the top side closed and the bottom open. It has a transverse release bar 23 attached to its front side. A venting needle 24 is affixed in depending relation within the lidding chamber for piercing the film drawn into the chamber.

The lidding chamber has an opening 25 in the top thereof connected to an evacuating device 26 by a flexible hose 27 which accommodates the movement of the lidding chamber. The evacuating device is comprised of a piston heat 26*a*, piston rod 26*b*, and a pneumatic cylinder 26*c*. A link arm 28 is pivotally attached at its forward end to the piston rod 26*b* and at its rearward end between the upper ends of two parallel bars 29 spaced apart by a cam follower 30. The lower ends of the parallel bars are pivotally mounted on an axle 31 extending across the rear of the chassis. The piston head is urged toward and maintained in its forward position shown in FIGS. 1 and 2 by a tension spring 32 shown in FIG. 2 attached at one end to a cross bar 33 and at its other end to arrest bar 14. The cam follower 30 interacts with an evacuating cam 34 mounted on cam shaft 21 to draw the piston head 26*a* rearwardly in the cylinder 26*c* via bars 28 and link arm 28 to evacuate the lidding chamber 12.

As shown in FIG. 1, the roll-stock elastomeric film 35 used for lidding is mounted on a spindle 36. A guide dowel 37, and two rollers 38*a* and 38*b* which form a film nip, define the first part of the path of the film web 35*a*. The forward nip roller 38*a* is fitted to a solenoid and linkage mechanism 39 to permit proper tension and payout of the web length. The rear nip roller 38*b* is attached via a cogged belt 40 to electric motor 41 and provides a drive to payout the film web. A dancer roller 42 attached to a cutoff switch 43 permits the motor to respond to the tension produced by the nip and the movement of the web by a carriage assembly 44. A second guide dowel 45 maintains the upward run of the web from contacting the downward run and a third dowel 46 directs the web forwardly under a gravity operated brake bar assembly 47 and onto a film guide plate 48. The brake bar allows the film to be fed forwardly but prevents it from slipping backwardly off the guide plate after the web is severed by a transverse segment of high resistence wire 49 carried by a pair of insulated supports 50 extending rearwardly from the lidding chamber. Electrical current to heat the wire is supplied through switch 51.

The carriage assembly 44 picks up the lead edge of the web 35*a* from the film guide plate 48 and carries it forwardly between the bottom of the lidding chamber 12 and the top of the clamping plate 22. The carriage assembly comprises pairs of housings 52, L-shaped lower jaw plates 53, upper gripping jaws 54, release pegs 55 and compression springs 56. The entire carriage assembly is mounted for reciprocal movement between a rearward position shown in FIG. 1 and a forward position shown in FIGS. 2 and 3 on upper and lower pairs of guide rods 57 and 58, respectively. The guide rods are mounted in front and rear in pairs of support plates 59 and 60, respectively.

Figure 3:
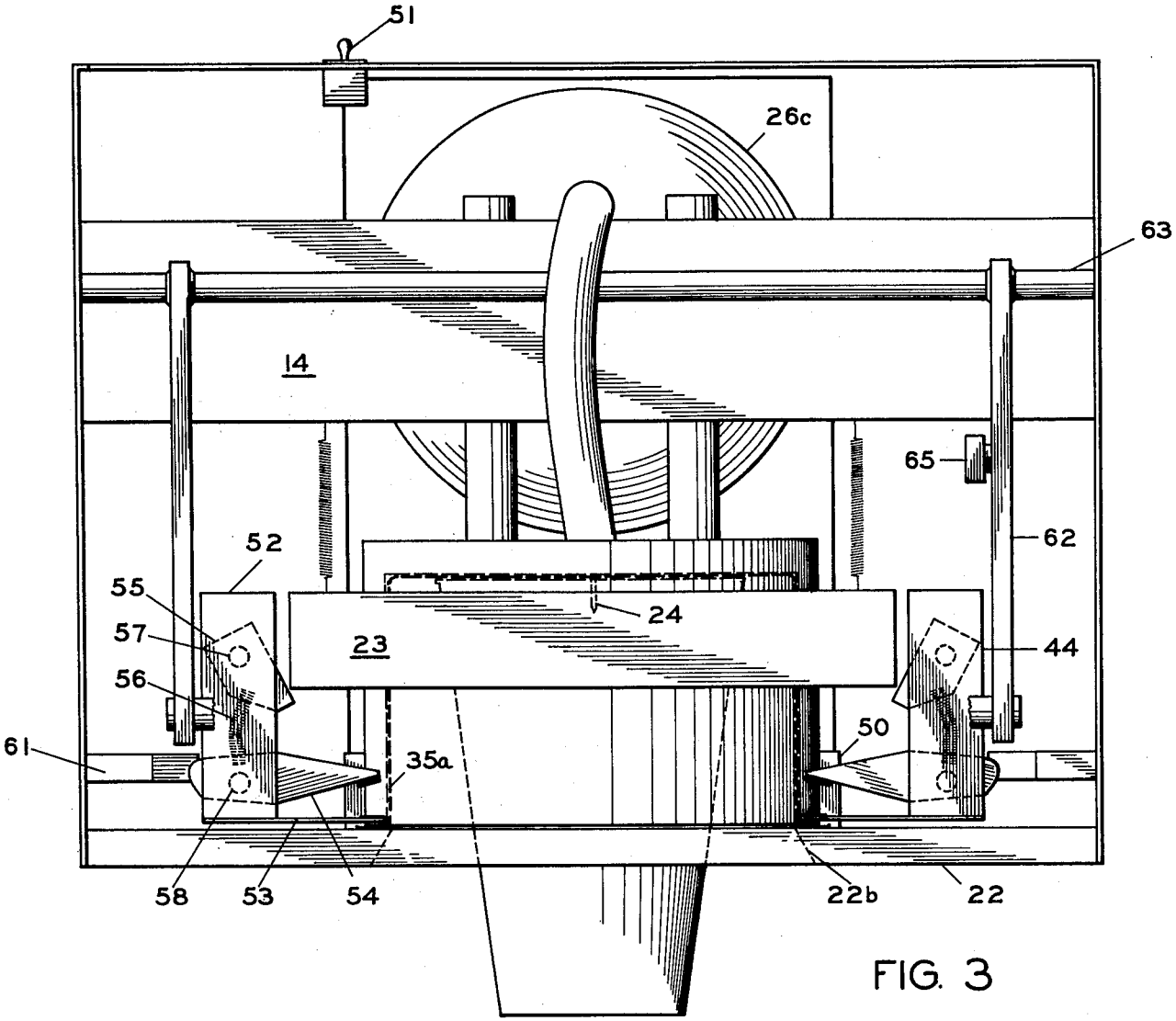
FIG. 3 is a simplified front elevation view principally of the carriage assembly of the apparatus of FIG. 1 and showing the stretched elastomeric web ready to be released onto a container.

The gripping jaws 54 are mounted on lower guide rods 58 for pivotal movement between open and closed positions and for sliding movement thereon forwardly and rearwardly with housings 52. Likewise the release pegs 55 are mounted on upper guide rods 57 for pivotal movement between an inwardly directed upper position and a lower position. The upper ends of compression springs 56 are carried in recesses in the release pegs while the lower ends are carried in recesses in the gripping jaws, as best shown in FIG. 3, whereby the springs are articulated right or left about their midsections to control the position of the gripping jaws and release pegs. As the gripping jaws are moved into their rearward position they are pivoted downwardly into a closed position onto the lead edge of the web by closing cams 61 mounted at the sides of the chassis. This pivoting of the gripping jaws downwardly by the closing cams causes the springs 56 to be articulated in the opposite direction in which they are shown in FIG. 3, thus pivoting the release pegs into their upper position. When the carriage assembly begins to move forwardly, springs 56 maintain the gripping jaws in their closed position after they are disengaged from the closing cams, thus holding the leading edge of the film web between the rear ends of the gripping jaws and the L-shaped jaw plates.

The carriage assembly 44 is driven rearwardly by lever arms 62 fixedly mounted at their top end to a rotatably journalled axle 63 extending across the chassis. The lower ends have slots 62*a* receiving pins 64 fixed to the front of housings 52. One of the lever arms 62 is pinned rear its midpoint to a link arm 65 which in turn is pinned to a second arm 66 having a cam follower 67 which rides on cam 68 mounted on cam shaft 21. The cam shaft 21 is driven by motor 41 through a cogged belt 69. The carriage assembly is moved forwardly by the action of tension spring 70 secured at its forward end to one of support plates 60 and at its rearward end to link arm 65.

The apparatus is cycled by a limit switch 71 controlled by a cam 72 on cam shaft 21 and a toggle switch 73 operated by a pivotable tripper plate 74.

The operation of the apparatus comprises a two part cycle encompassing one complete rotation of the cam shaft 21. The switch 51 is first turned on to heat the cut-off wire 49. The operation as it is described below assumes that the machine is loaded, that is, film web 35*a* has been carried forward during the previous cycle and extends under the lidding chamber.

The operator merely picks up the container 11 to be lidded and moves it inwardly under the chassis head 10*a* against the upper portion of the tripper plate 74 and then upwardly through the aperture in the clamping plate 22. The force of the hand-held container against the upper portion of tripper plate moves it rearwardly actuating the toggle switch 73 which turns on the electric motor 41. The motor thus begins rotating the cam shaft 21.

The initiation of the first part of the operating cycle causes cam 20 to pivot lever arm 16 downwardly carrying lidding chamber 12 downwardly onto clamping plate 22 to clamp the web in air-tight relation against the gasket 12*a* on bottom edge of the lidding chamber. As the lidding chamber is driven downwardly to its lower position shown in FIG. 3, it carries with it the release bar 23 which strikes the release pegs 55 pivoting them downwardly. This movement of the release pegs articulates the springs 56 into the position shown in FIG. 3, thus raising the gripping jaws 54 and releasing the web held in air-tight relation against the bottom of the lidding chamber by the clamping plate. The lowering of lidding chamber also causes the hot wire 49 to be moved downwardly through the web rearwardly of the lidding chamber to sever the web from the roll-stock. Immediately, upon the sealing of the web against the bottom of the lidding chamber, the continued rotation of the cam shaft causes cam 34 through cam follower 30, bars 29, link arm 28, and piston arm **26*b* to retract piston head 26*a* in cylinder 26*b*. This evacuates the lidding chamber above the elastomeric web and causes it to be stretched upwardly into the lidding chamber as shown in FIG. 3. The web is pierced by venting pin 24** as the web is drawn into the lidding chamber.

The top of the hand-held container is moved upwardly into the lidding chamber, preferably against the web stretched across the top of the lidding chamber as shown in FIG. 3, and held there momentarily. The continued rotation of the cam 20 allows the lever 16 to be pivoted upwardly and tension springs 15 pull the lever upwardly bringing the lidding chamber with it. This movement of the lidding chamber simultaneously breaks the air-tight seal with the web and releases the web from between the chamber and the clamping plate. The inherent restorative characteristic of the web causes the web to quickly recover, contracting tightly on the periphery of the container below its top. The container is thus lidded and cam 72 causes limit switch 71 to stop the first portion of the cycle.

The operator then lowers the lidded container and as the top of the container clears the clamping plate 22, the bottom of the container strikes the lower portion of the tripper plate 74 raising the toggle of switch 73. This commences the second portion of the cycle. The continued rotation of the cam shaft causes cam 68 to act on follower 67 to retract arm 65 and thus pivot levers 62 rearwardly bringing with them the carriage assembly with its jaws open to pick up the lead edge of the web resting on film guide plate 48. As the carriage reaches its rearward position, the open gripping jaws 54 engage against cams 61 closing the jaws down onto the L-shaped jaw plates to grip the web between the rearwardly extending portions of the jaws and jaw plates.

As the cam 68 continues to rotate, the spring 70 pulls the carriage assembly forwardly. The springs 56 maintain the gripping jaws 54 in their closed position while the carriage moves forwardly carrying the lead edge of the web with it. Simultaneously the solenoid mechanism 39 causes the nip rollers **38*a* and 38*b*** to feed the film web forwardly from the roll-stock. When the carriage assembly has reached its forward position with the film again extending under the lidding chamber, the machine is loaded and ready to commence a new cycle for lidding the next container.

While a circular top container is shown for exemplification of the method and apparatus, other container shapes can also be lidded by the method and apparatus either with or without modification. If, for example, it is desired to lid a substantially square topped container it may be desirable to modify the apparatus to provide a corresponding square lidding chamber and aperture in the clamping plate.

Further, when lidding a circular container for instance, it may be desirable to cut a circular web rather than a square web from the roll-stock, in which case means would be provided for taking up the broke.

There are a number of elastomeric films that can be utilized including, but not necessarily limited to: Styrene Butadiene, Bunan Nitrile, Neoprene, Ethylene Propylene Copolymer, Polyurethane, and Polyisoprene (natural and synthetic). These materials can be obtained commercially in suitable thicknesses between about 1 and 5 mils, about 3.0 mils to 3.5 mils being found particularly satisfactory. Such films have a high tensile strength with a maximum near 3,000 psi and stretchability ranging as high as 600% elongation. However, even more important than the high elongation factor is the restorative characteristic or recovery ratio which should be a minimum of about 85% of its original size and preferably about 90–95%.

It should be understood that our invention is not confined to the particular construction and steps herein illustrated and described for exemplification, but embraces all such modified forms thereof as come within the scope of the following claims.

We claim:

1. Apparatus for cold lidding an open-top container with roll-stock elastomeric film, comprising:

a. a chassis having a head portion, b. an open-bottom lidding chamber mounted in said chassis head, c. a clamping plate mounted in said chassis head below said lidding chamber and having an aperture through which the open-top container to be lidded can be inserted, d. means for presenting a web of the roll-stock elastomeric film across the bottom of said lidding chamber and above said clamping plate, e. means for bringing said lidding chamber and clamping plate into mating relationship to clamp said web in air-tight relationship with the bottom of said lidding chamber, f. means for evacuating said lidding chamber to stretch said web upwardly into said lidding chamber, and g. means for separating said lidding chamber and said clamping plate from said mating relationship to release said stretched web over the top of a container inserted into said lidding chamber.

2. The apparatus as specified in claim 1 wherein said lidding chamber is mounted in said chassis head for vertical reciprocation between an upper position and a lower position, said means for bringing said lidding chamber and clamping plate into mating relationship comprises means for moving said lidding chamber downwardly to its lower position, and said means for separating said lidding chamber and clamping plate comprises means for raising said lidding chamber to its upper position.

3. The apparatus as specified in claim 1 wherein said means for evacuating said lidding chamber comprises a piston and cylinder.

4. The apparatus as specified in claim 1 wherein said means for presenting a web of the roll-stock elastomeric film across the bottom of said lidding chamber comprises a reciprocal carriage assembly having jaws for gripping the edge of said web and carrying it across the bottom of said lidding chamber; and comprising means for releasing the gripping action of said jaws on said web before said means for separating said lidding chamber and said clamping plate releases said stretched web.

* * * * *